US010577552B2

(12) United States Patent
Babcock et al.

(10) Patent No.: US 10,577,552 B2
(45) Date of Patent: Mar. 3, 2020

(54) IN-LINE L-GRADE RECOVERY SYSTEMS AND METHODS

(71) Applicants: Linde Aktiengesellschaft, Munich (DE); John A. Babcock, Houston, TX (US)

(72) Inventors: John A. Babcock, Houston, TX (US); Charles P. Siess, III, Conroe, TX (US)

(73) Assignee: Linde Aktiengesellschaft, Munich (DE)

( * ) Notice: Subject to any disclaimer, the term of this patent is extended or adjusted under 35 U.S.C. 154(b) by 287 days.

(21) Appl. No.: 15/493,854

(22) Filed: Apr. 21, 2017

(65) Prior Publication Data

US 2018/0216880 A1 Aug. 2, 2018

Related U.S. Application Data

(60) Provisional application No. 62/453,433, filed on Feb. 1, 2017.

(51) Int. Cl.

| | |
|---|---|
| ***F25J 3/02*** | (2006.01) |
| ***C10L 3/10*** | (2006.01) |
| ***C10L 3/12*** | (2006.01) |
| ***C10G 5/00*** | (2006.01) |

(52) U.S. Cl.

CPC ..... *C10L 3/10* (2013.01); *C10G 5/00* (2013.01); *C10L 3/12* (2013.01); *C10G 2300/1025* (2013.01); *C10L 3/106* (2013.01)

(58) Field of Classification Search

CPC ..... C10G 2300/1025; C10G 5/00; C10L 3/10; C10L 3/106; C10L 3/12

See application file for complete search history.

(56) References Cited

U.S. PATENT DOCUMENTS

| | | | |
|---|---|---|---|
| 3,035,637 | A | 5/1962 | Allen |
| 3,316,965 | A | 5/1967 | Watanabe |
| 3,319,712 | A | 5/1967 | O'Brien |
| 3,368,627 | A | 2/1968 | Hurst et al. |
| 4,490,985 | A | 1/1985 | Wells |
| 4,511,381 | A | 4/1985 | Mehra |
| 6,230,814 | B1 | 5/2001 | Nasr et al. |
| 7,373,790 | B2 | 5/2008 | Clare et al. |
| 8,505,332 | B1 | 8/2013 | Prim |

(Continued)

FOREIGN PATENT DOCUMENTS

| | | | |
|---|---|---|---|
| DE | 102014010105 | A1 | 1/2016 |
| FR | 2466606 | A1 | 4/1981 |

(Continued)

OTHER PUBLICATIONS

M. Asadi et al., "Water-Free Fracturing: A Case History", Society of Petroleum Engineers, SPE-175988-MS, 14 Pages.

(Continued)

*Primary Examiner* — Cabrena Holecek

(74) *Attorney, Agent, or Firm* — Patterson + Sheridan, LLP

(57) ABSTRACT

An in-line L-Grade recovery system having a first in-line separator in communication with a natural gas stream and configured to separate the natural gas stream into a gas stream and a liquid stream, a second in-line separator in communication with the first in-line separator and configured to separate the liquid stream into L-Grade and water, and a storage tank in communication with the second in-line separator and configured to store the L-Grade.

27 Claims, 6 Drawing Sheets

(56) References Cited

U.S. PATENT DOCUMENTS

| | | | |
|---|---|---|---|
| 8,844,639 | B2 | 9/2014 | Gupta et al. |
| 9,488,040 | B2 | 11/2016 | Chakrabarty et al. |
| 9,534,836 | B2 | 1/2017 | Dubettier-Grenier et al. |
| 2005/0189112 | A1 | 9/2005 | Taylor et al. |
| 2006/0144080 | A1* | 7/2006 | Heath ..... C10G 5/06 62/617 |
| 2006/0289166 | A1 | 12/2006 | Stromquist et al. |
| 2007/0000666 | A1 | 1/2007 | Vozniak et al. |
| 2007/0187340 | A1 | 8/2007 | Oresti et al. |
| 2008/0087041 | A1 | 4/2008 | Denton et al. |
| 2012/0000660 | A1 | 1/2012 | Gatlin et al. |
| 2012/0047942 | A1 | 3/2012 | Kolodziej |
| 2013/0168086 | A1 | 7/2013 | Roberts |
| 2013/0220605 | A1 | 8/2013 | Vandor |
| 2013/0299167 | A1 | 11/2013 | Fordyce et al. |
| 2014/0000899 | A1 | 1/2014 | Nevison |
| 2014/0124208 | A1 | 5/2014 | Loree et al. |
| 2014/0366577 | A1 | 12/2014 | Zubrin et al. |
| 2015/0021022 | A1 | 1/2015 | Ladva et al. |
| 2015/0152318 | A1 | 6/2015 | Travis |
| 2015/0167550 | A1 | 6/2015 | Vandervort et al. |
| 2015/0184932 | A1 | 7/2015 | Higginbotham et al. |
| 2015/0233222 | A1 | 8/2015 | Teklu et al. |
| 2015/0368566 | A1 | 12/2015 | Young et al. |

FOREIGN PATENT DOCUMENTS

| | | | |
|---|---|---|---|
| GB | 2219818 | A | 12/1989 |
| WO | 2010025540 | A1 | 3/2010 |
| WO | 2012097424 | A1 | 7/2012 |
| WO | 2015020654 | A1 | 2/2015 |
| WO | 2016064645 | A1 | 4/2016 |

OTHER PUBLICATIONS

Ginley, "Osudo Reservoir Fluid Study Jordan B No. 1 Well", http://ocdimage.emnrd.state.nm.us/imaging/filestore/SantaFeAdmin/CF/ADA-03-00539 Case Files Part 6/10796_4159.pdf, pp. 1,5; table 2, Jan. 1, 1992.

Holtz et al., "Summary Integrated Geologic and Engineering Determination of Oil-Reserve-Growth Potential in Carbonate Reservoirs", https://www.onepetro.org/download/journal-paper/SPE-22900-PA?id=journal-paper/SPE-22900-PA, p. 1250 and 1253, Jan. 1, 1992.

Nakashima et al., "SPE-177801-MS Development of a Giant Carbonate Oil Field, Part 2: Mitigration from Pressure Maintenance Developement to Sweep Oriented IOR Development", https://www.onepetro.org/download/conference-paper/SPE-177801-MS?id=conference-paper/SPE-177801-MS, pp. 1-8 and 12-16, Jan. 1, 2015.

Pazuki et al., "A modified Flory-Huggins model for prediction of asphaltenes precipitation in crude oil", Fuel, IPC Science and Technology Press, Guildford, GB, vol. 85, No. 7-8, pp. 1083-1086, May 1, 2016.

Qing Sun et al., "Quantification of uncertainity in recovery efficiency predictions: lessons learned from 250 mature carbonate fields", SPE 84459, pp. 1-15, Jan. 1, 2005.

Rassenfoss; "In Search of the waterless fracture", JPT, Jun. 30, 2013, pp. 46-54, XP055237780.

* cited by examiner

IN-LINE L-GRADE RECOVERY SYSTEMS AND METHODS

CROSS-REFERENCE TO RELATED APPLICATION

This application claims priority to U.S. Provisional Application Ser. No. 62/453,433, filed Feb. 1, 2017, which is incorporated by reference herein in its entirety.

BACKGROUND

Field

Embodiments of this disclosure generally relate to in-line L-Grade recovery systems and methods.

Description of the Related Art

Hydraulic fracture treatments are utilized to stimulate and improve fluid conductivity between a wellbore and a formation of interest to increase fluid production rate and associated reserves. Recent data suggests that approximately 98% of the hydraulic fracture treatments in the U.S. utilize water-based stimulation fluids (also referred to as fracing fluids). Water-based fracing fluids have associated acquisition, disposal, clean-up, and/or usage issues and conflicts that can damage the formation and require chemical additions. Massive hydraulic fracture treatments traditionally use 100,000 barrels of water or more.

Therefore, there is a need for new stimulation fluids that are non-damaging to the formation, have minimal water content and chemical additions, are naturally occurring and locally available components, have fast clean-up, are cost effective, and are totally recoverable with minimal proppant flow back.

SUMMARY

An L-Grade and/or Y-Grade NGL based stimulation fluid comprised either as a foam, gel, or emulsion as described herein meets the need for a new stimulation fluid that is non-damaging to the formation, has minimal water content and chemical additions, is naturally occurring and locally available, has fast clean-up, is cost effective, and is totally recoverable with minimal proppant flow back.

One embodiment of this disclosure comprises an L-Grade recovery system which can be connected to an individual unconventional well or multi-well production facility on an oil and gas lease and located in a designated area classified as Class 1 Division 1 or Division 2 to recover and store L-Grade for later use as a stimulation fluid, such as a hydraulic fracing fluid in hydraulic fracturing operations.

One embodiment of this disclosure comprises a train (e.g. a series) of two in-line separators. A first in-line separator is a carbon steel vessel with a maximum working pressure of 1,440 psig, and a liquid and gas capacity of 5,000 bfpd and 20 MMcfd of natural gas, respectively. The first in-line separator has a flanged inlet and two flanged outlets; a four inch liquid outlet and a three inch gas outlet all with ANSI 600 rating. A second in-line separator is of similar composition, pressure rating, and capacity as the first in-line separator. The second in-line separator also has two flanged outlets; a four inch L-Grade outlet and a three inch water outlet all with ANSI 600 rating.

One embodiment of this disclosure comprises a choke manifold attached to a gas discharge line of the first in-line separator. One embodiment of this disclosure comprises a choke manifold attached to an L-Grade discharge line of the second in-line separator. One embodiment of this disclosure comprises a choke manifold attached to a water discharge line of the second in-line separator. An example of any of these choke manifolds is an adjustable choke with flanged three inch inlet and outlets manufactured from carbon steel with ANSI 600 rating.

One embodiment of this disclosure comprises one or more L-Grade pressurized mobile storage vessels. An example of the storage vessels is a carbon steel bullet shaped shell with a capacity of 30,000 gallons rated to a maximum working pressure of 350 psig. One embodiment of this disclosure comprises a nitrogen blanketing system for the L-Grade pressurized mobile storage vessels.

BRIEF DESCRIPTION OF THE DRAWING

So that the manner in which the above recited features can be understood in detail, a more particular description of the embodiments briefly summarized above may be had by reference to the embodiment below, some of which are illustrated in the appended drawing. It is to be noted, however, that the appended drawing illustrate only typical embodiments and are therefore not to be considered limiting of its scope, for the embodiments may admit to other equally effective embodiments.

DETAILED DESCRIPTION

Figure 1:
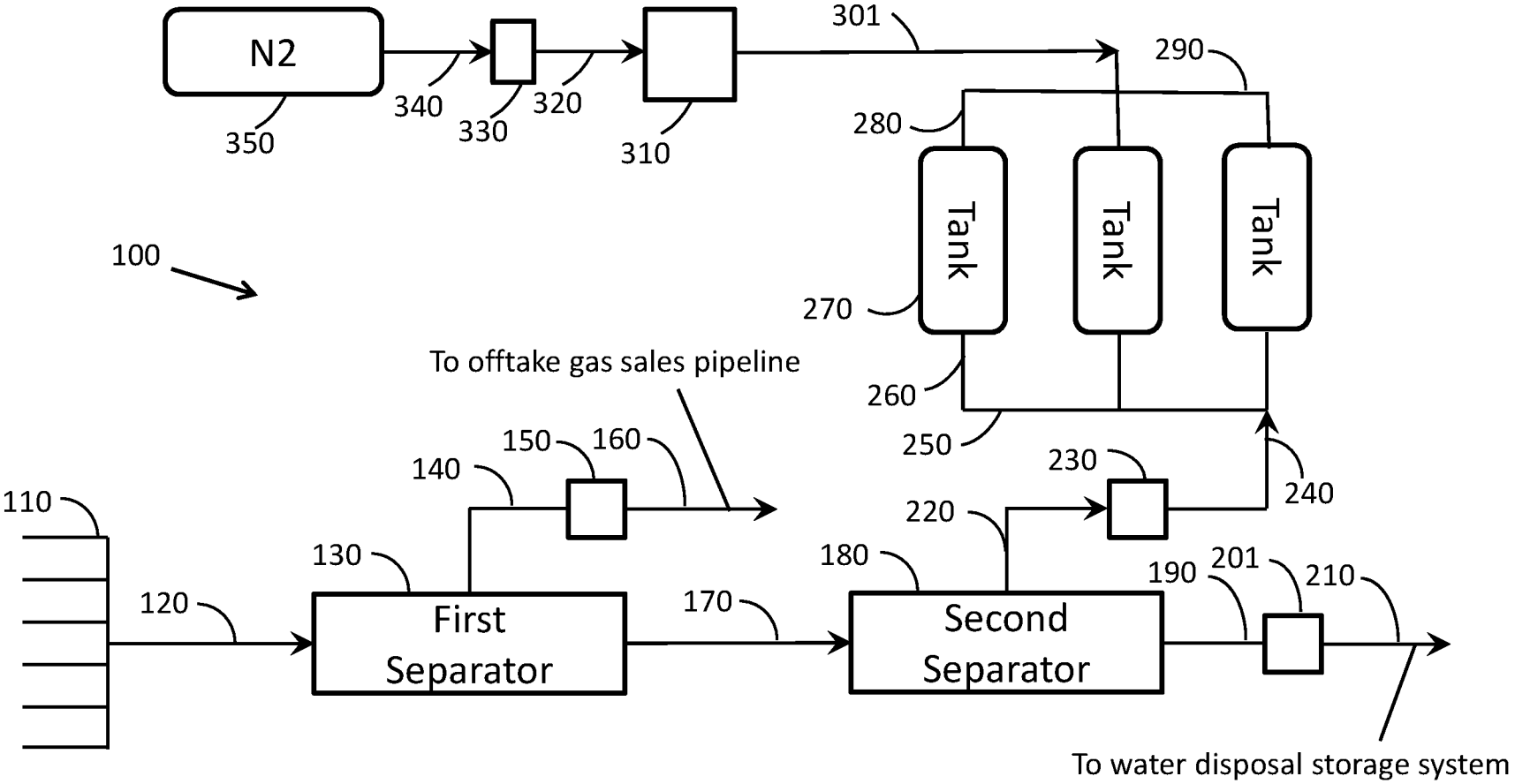
FIG. 1 shows a plan schematic of an in-line L-Grade recovery system according to one embodiment.

L-Grade is an unfractionated hydrocarbon mixture comprising natural gas liquids, condensate (including aromatics), and traces of water, carbon dioxide, nitrogen, and/or hydrogen sulfide. The natural gas liquids in the L-Grade mixture comprise ethane, propane, butane, isobutane, and pentane plus. Pentane plus comprises pentane, isopentane, and/or heavier weight hydrocarbons, for example hydrocarbon compounds containing C5 through C35. Pentane plus may include natural gasoline for example.

Typically, L-Grade is a by-product of de-methanized hydrocarbon streams that are produced from shale wells and transported to a centralized facility. L-Grade typically includes natural gas liquids and condensate with an API gravity ranging between 50 degrees and 75 degrees.

L-Grade differs from condensate in that L-Grade is stored at a pressure between about 250 psig to about 600 psig, whereas condensate is stored at atmospheric conditions (e.g. pressure and temperature).

L-Grade can be recovered from a hydrocarbon stream that is collected from the wellhead or production header of one or more unconventional resource wells, typically referred to as shale wells, via flash separation at pressures that are typically below 600 psig. This is accomplished by utilizing flash separation operated at low enough pressure to reject the vast majority of methane from the hydrocarbon stream, but at high enough pressure to retain a significant portion of the ethane plus mixture.

Y-Grade natural gas liquids (referred to herein as Y-Grade NGL) is an un-fractionated hydrocarbon mixture comprising ethane, propane, butane, isobutane, and pentane plus. Pentane plus comprises pentane, isopentane, and/or heavier weight hydrocarbons, for example hydrocarbon compounds containing at least one of C5 through C8+. Pentane plus may include natural gasoline for example.

Typically, Y-Grade NGL is a by-product of de-methanized hydrocarbon streams that are produced from shale wells and transported to a centralized facility. Y-Grade NGL can be locally sourced from a splitter facility, a gas plant, and/or a refinery and transported by truck or pipeline to a point of use. In its un-fractionated or natural state (under certain pressures and temperatures, for example within a range of 250-600 psig and at wellhead or ambient temperature), Y-Grade NGL has no dedicated market or known use. Y-Grade NGL must undergo processing before its true value is proven.

The Y-Grade NGL composition can be customized for handling as a liquid under various conditions. Since the ethane content of Y-Grade NGL affects the vapor pressure, the ethane content can be adjusted as necessary. According to one example, Y-Grade NGL may be processed to have a low ethane content, such as an ethane content within a range of 3-12 percent, to allow the Y-Grade NGL to be transported as a liquid in low pressure storage vessels. According to another example, Y-Grade NGL may be processed to have a high ethane content, such as an ethane content within a range of 38-60 percent, to allow the Y-Grade NGL to be transported as a liquid in high pressure pipelines.

Y-Grade NGL differs from liquefied petroleum gas ("LPG"). One difference is that LPG is a fractionated product comprised of primarily propane, or a mixture of fractionated products comprised of propane and butane. Another difference is that LPG is a fractioned hydrocarbon mixture, whereas Y-Grade NGL is an unfractionated hydrocarbon mixture. Another difference is that LPG is produced in a fractionation facility via a fractionation train, whereas Y-Grade NGL can be obtained from a splitter facility, a gas plant, and/or a refinery. A further difference is that LPG is a pure product with the exact same composition, whereas Y-Grade NGL can have a variable composition.

In its unfractionated state, Y-Grade NGL is not an NGL purity product and is not a mixture formed by combining one or more NGL purity products. An NGL purity product is defined as an NGL stream having at least 90% of one type of carbon molecule. The five recognized NGL purity products are ethane (C2), propane (C3), normal butane (NC4), isobutane (IC4) and natural gasoline (C5+). The unfractionated hydrocarbon mixture must be sent to a fractionation facility, where it is cryogenically cooled and passed through a fractionation train that consists of a series of distillation towers, referred to as deethanizers, depropanizers, and debutanizers, to fractionate out NGL purity products from the unfractionated hydrocarbon mixture. Each distillation tower generates an NGL purity product. Liquefied petroleum gas is an NGL purity product comprising only propane, or a mixture of two or more NGL purity products, such as propane and butane. Liquefied petroleum gas is therefore a fractionated hydrocarbon or a fractionated hydrocarbon mixture.

In one embodiment, Y-Grade NGL comprises 30-80%, such as 40-60%, for example 43%, ethane, 15-45%, such as 20-35%, for example 27%, propane, 5-10%, for example 7%, normal butane, 5-40%, such as 10-25%, for example 10%, isobutane, and 5-25%, such as 10-20%, for example 13%, pentane plus. Methane is typically less than 1%, such as less than 0.5% by liquid volume.

In one embodiment, Y-Grade NGL comprises dehydrated, desulfurized wellhead gas condensed components that have a vapor pressure of not more than about 600 psig at 100 degrees Fahrenheit (° F.), with aromatics below about 1 weight percent, and olefins below about 1% by liquid volume. Materials and streams useful for the embodiments described herein typically include hydrocarbons with melting points below about 0 degrees Fahrenheit (° F.).

According to one embodiment, an L-Grade recovery system includes a train (e.g. a series) of in-line separators (e.g. a first in-line separator and a second in-line separator) and corresponding chokes that are operated at line pressure to recover L-Grade from a natural gas stream. The natural gas stream is supplied into the first in-line separator where it is separated into a gas stream and a liquid stream. The gas stream from the first in-line separator is discharged through a choke and into an offtake gas sales pipeline. The liquid stream is discharged from the first in-line separator and supplied to the second in-line separator where it is separated into L-Grade and water. L-Grade is discharged from the second in-line separator and flows through a choke operated at a pressure setting to recover a unique composition of L-Grade that can be stored in one or more pressurized, nitrogen blanketed storage tanks. The stored L-Grade can then be transported to a hydraulic fracturing site under pressure and utilized as a stimulation fluid, such as a hydraulic fracing fluid. Water is discharged from the second in-line separator through a choke and sent to a water disposal storage system.

FIG. 1 shows a plan schematic of an L-Grade recovery system 100 that can be used to recover and create a unique composition of L-Grade. The recovery system 100 includes a wellhead header 110 that is in communication with an inlet of a first in-line separator 130 via line 120. A natural gas stream flows from the wellhead header 110 into the first in-line separator 130. The natural gas stream comprises gas, hydrocarbons, and water. The natural gas stream is separated by the first in-line separator 130 into a gas stream and a liquid stream. The pressure of the natural gas stream in the line 120 flowing into the first in-line separator 130 may typically be about 1,000 psig.

The gas stream separated by the first in-line separator 130 comprises gas saturated with hydrocarbons (e.g. natural gas liquids such as Y-Grade NGL) and water vapor. The gas stream from the first in-line separator 130 is discharged via line 140 and flows through a choke 150 and then is discharged into an offtake gas sales pipeline via line 160. The choke 150 may be configured to maintain a back pressure, lower than 1,000 psig for example, on the first in-line separator 130 to separate out the desired amount of gas from the natural gas stream. The liquid stream, which comprises liquid hydrocarbons (e.g. L-Grade) and water, is discharged from the first in-line separator 130 (at substantially the same pressure, e.g. about 1,000 psi) and flows to a second in-line separator 180 via line 170 where it is separated into L-Grade and water.

L-Grade is discharged from the second in-line separator 180 via line 220 (at substantially the same pressure, e.g. about 1,000 psi) and flows into a choke 230 where the pressure is regulated (e.g. lowered to about 250-600 psig) to obtain the desired L-Grade composition. The choke 150 and/or the choke 230 may be used to maintain a specific back pressure on the first and/or second in-line separators 130, 180 to obtain the desired composition of L-Grade. L-Grade exits the choke 230 via line 240 and into manifold 250 where it is stored in one or more mobile L-Grade storage tanks 270 via line 260.

The L-Grade storage tanks 270 may be gas blanketed with nitrogen. Liquid nitrogen from a storage tank 350 is discharged into a cryogenic pump 330 via line 340 and then into a vaporizer 310 via line 320, where the liquid nitrogen is vaporized into gaseous nitrogen. The gaseous nitrogen is discharged from the vaporizer 310 via line 301 into manifold 290 and then into the one or more mobile L-Grade storage tanks 270 via lines 280, where the gaseous nitrogen forms a gas blanket within the storage tanks 270 above the L-Grade.

Water is discharged from the second in-line separator 180 via line 190 (at substantially the same pressure, e.g. about 1,000 psi) and flows into a choke 201 to regulate the pressure of the stream of water (e.g. lower the pressure to atmospheric conditions), which is then supplied to a water disposal storage system via line 210.

In one embodiment, at least one of the first and second in-line separators 130, 180 are centrifugal separators. In one embodiment, at least one of the first and second in-line separators 130, 180 are cyclone separators. In one embodiment, at least one of the first and second in-line separators 130, 180 are multi-chambered separators.

In one embodiment, the first in-line separator 130 is configured to separate the natural gas stream into a gas stream and a liquid stream by density segregation, such as by applying a centrifugal force to the natural gas stream to separate the less dense gas from the more dense liquid. In one embodiment, the second in-line separator 180 is configured to separate the liquid stream from the first in-line separator 130 into L-Grade and water by density segregation, such as by applying a centrifugal force to the liquid stream to separate the less dense L-Grade from the more dense water.

In one embodiment, the first and/or second in-line separators 130, 180 are configured to separate the natural gas stream into a gas stream and a liquid stream by velocity segregation, by accelerating a multiphase fluid through a nozzle or orifice whereby the gaseous phase resides in the center of the flow stream accelerating faster than the liquid phase that occupies the outer portion of the stream and which is being held up on the wall of the pipe due to friction. Based on velocity segregation, it is possible to mechanically segregate a significant portion of the liquid phase from the stream by mechanically separating out a portion of the flow stream at a location near the outer portion of the flow stream. Based on velocity segregation, it is possible to mechanically segregate a significant portion of the gaseous phase from the stream by mechanically separating out a portion of the flow stream at a location near the center of the flow stream.

Figure 2:
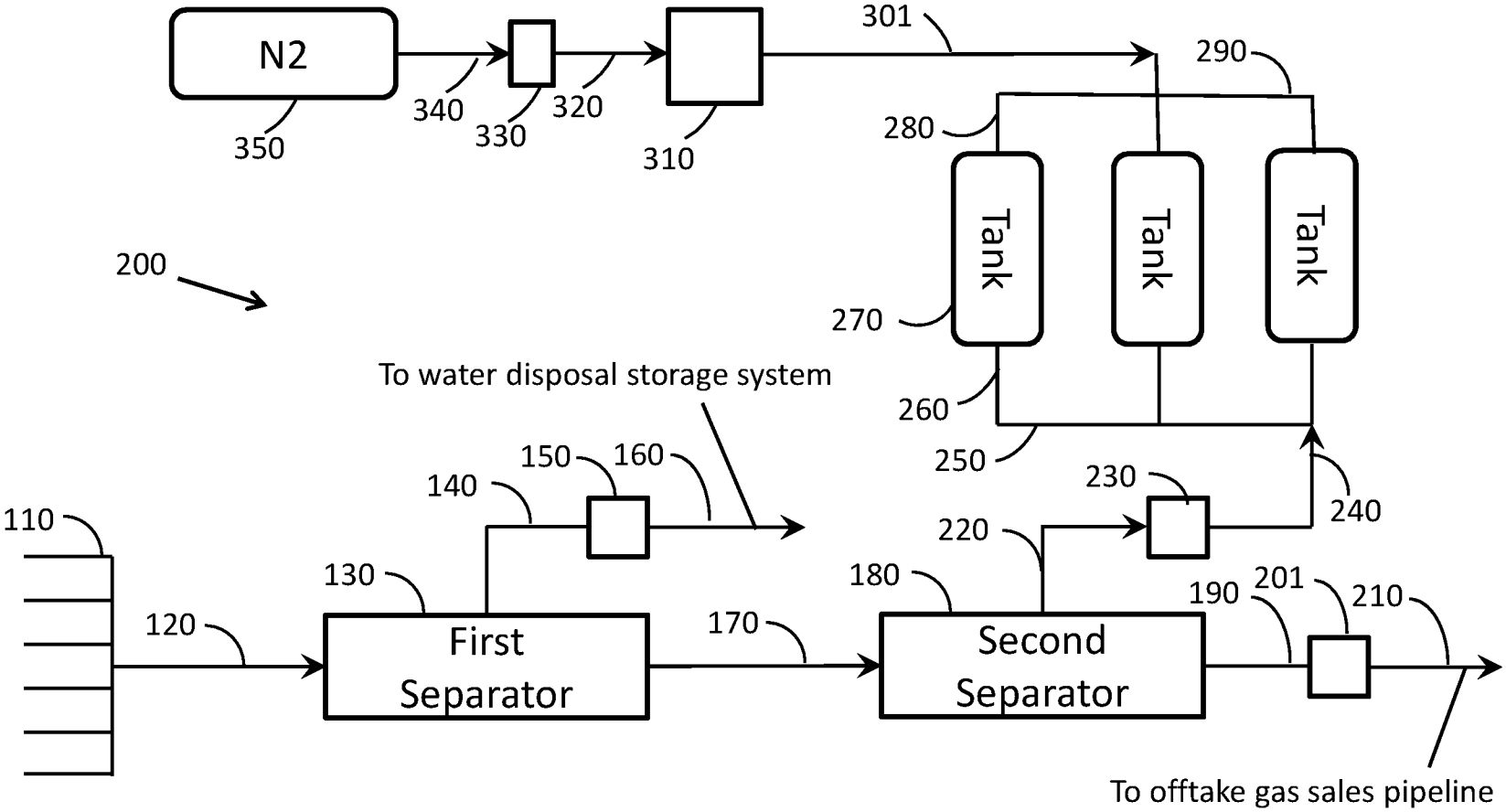
FIG. 2 shows a plan schematic of an in-line L-Grade recovery system according to one embodiment.

FIG. 2 shows a plan schematic of an L-Grade recovery system 200 that can be used to recover and create a unique composition of L-Grade. The recovery system 200 is similar to the recovery system 100 shown in FIG. 1. One difference of the recovery system 200 is that the first in-line separator 130 separates the natural gas stream into water and hydrocarbons. The water from the first in-line separator 130 is discharged via line 140 and flows through the choke 150 and then is discharged to a water disposal system via line 160. The hydrocarbon stream, which may include some water vapor, is discharged from the first in-line separator 130 (at substantially the same pressure, e.g. about 1,000 psi) and flows to the second in-line separator 180 via line 170 where it is separated into liquid hydrocarbons (e.g. L-Grade) and a gas stream. The gas stream may comprise gas saturated with hydrocarbons (e.g. natural gas liquids such as Y-Grade NGL) and water vapor.

L-Grade is discharged from the second in-line separator 180 via line 220 (at substantially the same pressure, e.g. about 1,000 psi) and flows into the choke 230 where the pressure is regulated (e.g. lowered to about 250-300 psig) to obtain the desired L-Grade composition. The choke 150 and/or the choke 230 may be used to maintain a specific back pressure on the first and/or second in-line separators 130, 180 to obtain the desired composition of L-Grade. L-Grade exits the choke 230 via line 240 and into manifold 250 where it is stored in the one or more mobile L-Grade storage tanks 270 via line 260. The gas stream is discharged from the second in-line separator 180 via line 190 (at substantially the same pressure, e.g. about 1,000 psi) and flows into the choke 201 to regulate the pressure of the gas stream that is then discharged into an offtake gas sales pipeline via line 160.

Figure 3:
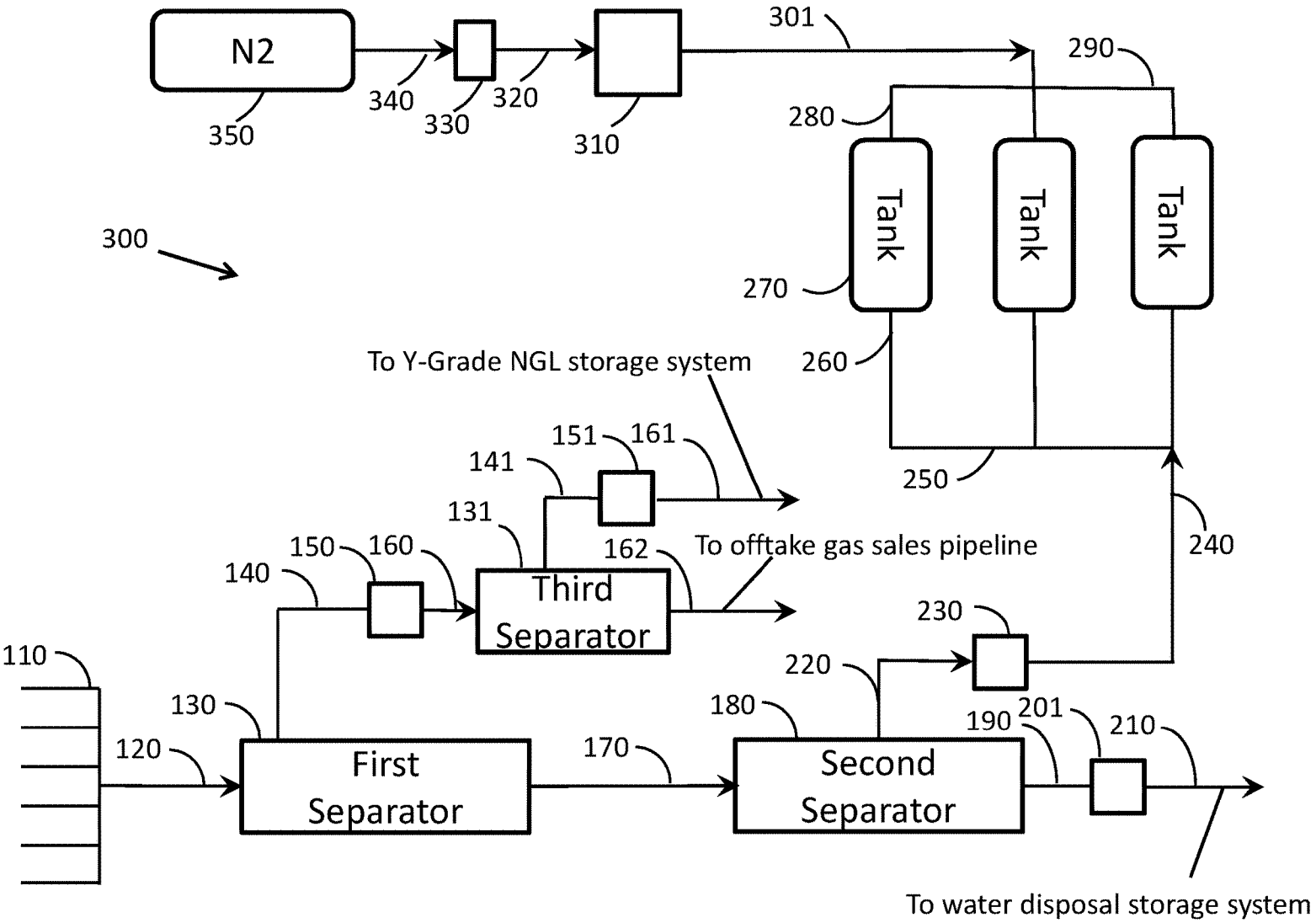
FIG. 3 shows a plan schematic of an in-line L-Grade recovery system according to one embodiment.

FIG. 3 shows a plan schematic of an L-Grade recovery system 300 that can be used to recover and create a unique composition of L-Grade and Y-Grade NGL. The recovery system 300 is similar to the recovery system 100 shown in FIG. 1. One difference of the recovery system 300 from the recovery system 100 is the addition of a third in-line separator 131 to separates out some Y-Grade NGL from the gas stream that is discharged from the first in-line separator 130.

The gas stream flows from the first in-line separator 130 through the choke 150 and into the third in-line separator 131 via line 160 where Y-Grade NGL is separated out from the gas stream. Y-Grade NGL is discharged from the third in-line separator 131 via line 141 and flows through a choke 151 to a Y-Grade NGL storage system via line 161. The remaining gas stream, which may still contain some hydrocarbons (e.g. natural gas liquids such as Y-Grade NGL) and water vapor, is discharged from the third in-line separator 131 into an offtake gas sales pipeline via line 162.

Figure 4:
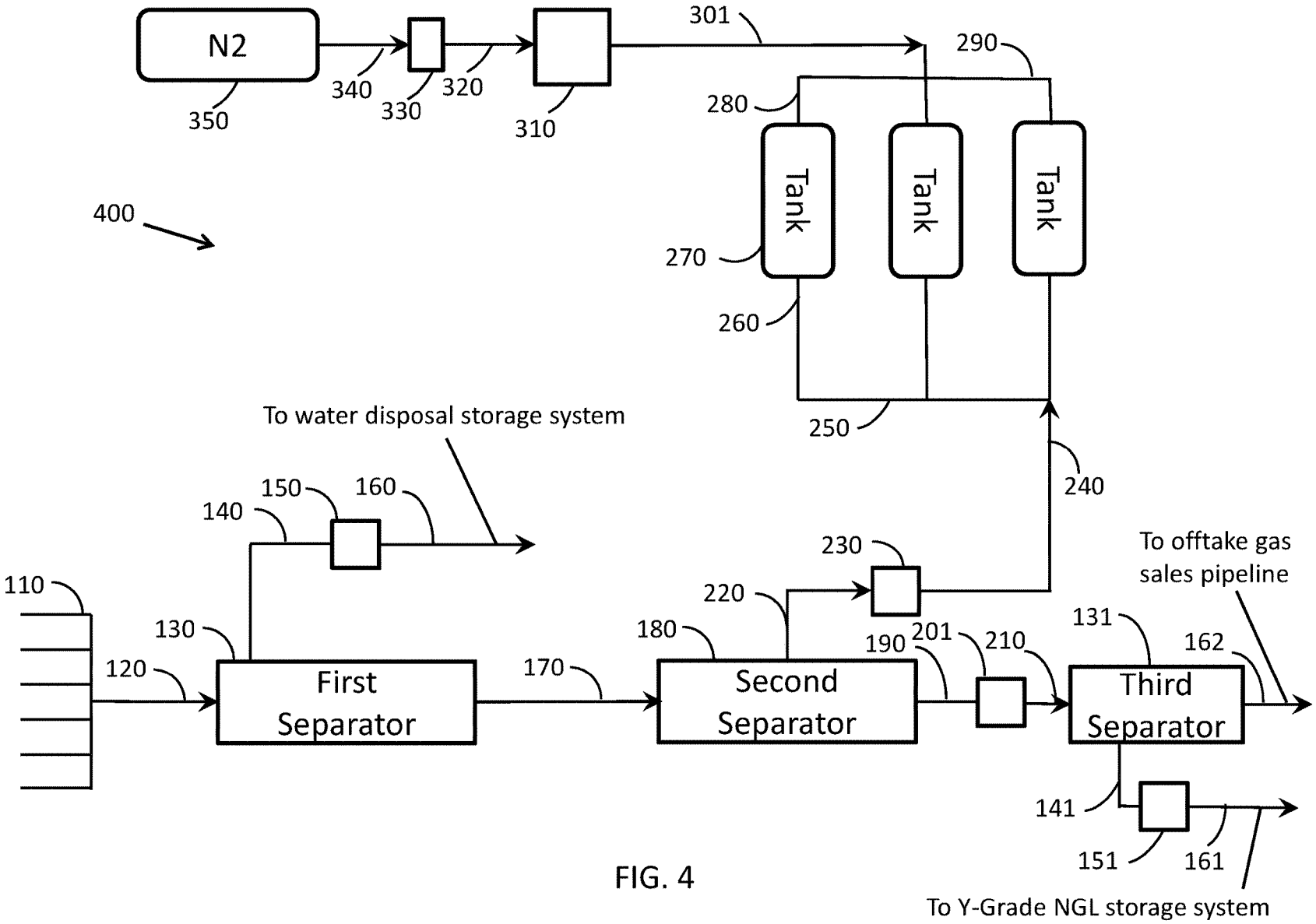
FIG. 4 shows a plan schematic of an in-line L-Grade recovery system according to one embodiment.

FIG. 4 shows a plan schematic of an L-Grade recovery system 400 that can be used to recover and create a unique composition of L-Grade and Y-Grade NGL. The recovery system 400 is similar to the recovery system 200 shown in FIG. 2. One difference of the recovery system 400 from the recovery system 200 is the addition of the third in-line separator 131 to separate out some Y-Grade NGL from the gas stream that is discharged from the second in-line separator 180.

The gas stream flows from the second in-line separator 180 through the choke 201 and into the third in-line separator 131 via line 210 where Y-Grade NGL is separated out form the gas stream. Y-Grade NGL is discharged from the third in-line separator 131 via line 141 and flows through the choke 151 to a Y-Grade NGL storage system via line 161. The remaining gas stream, which may still contain some hydrocarbons (e.g. natural gas liquids such as Y-Grade NGL) and water vapor, is discharged from the third in-line separator 131 into the offtake gas sales pipeline via line 162.

Figure 5:
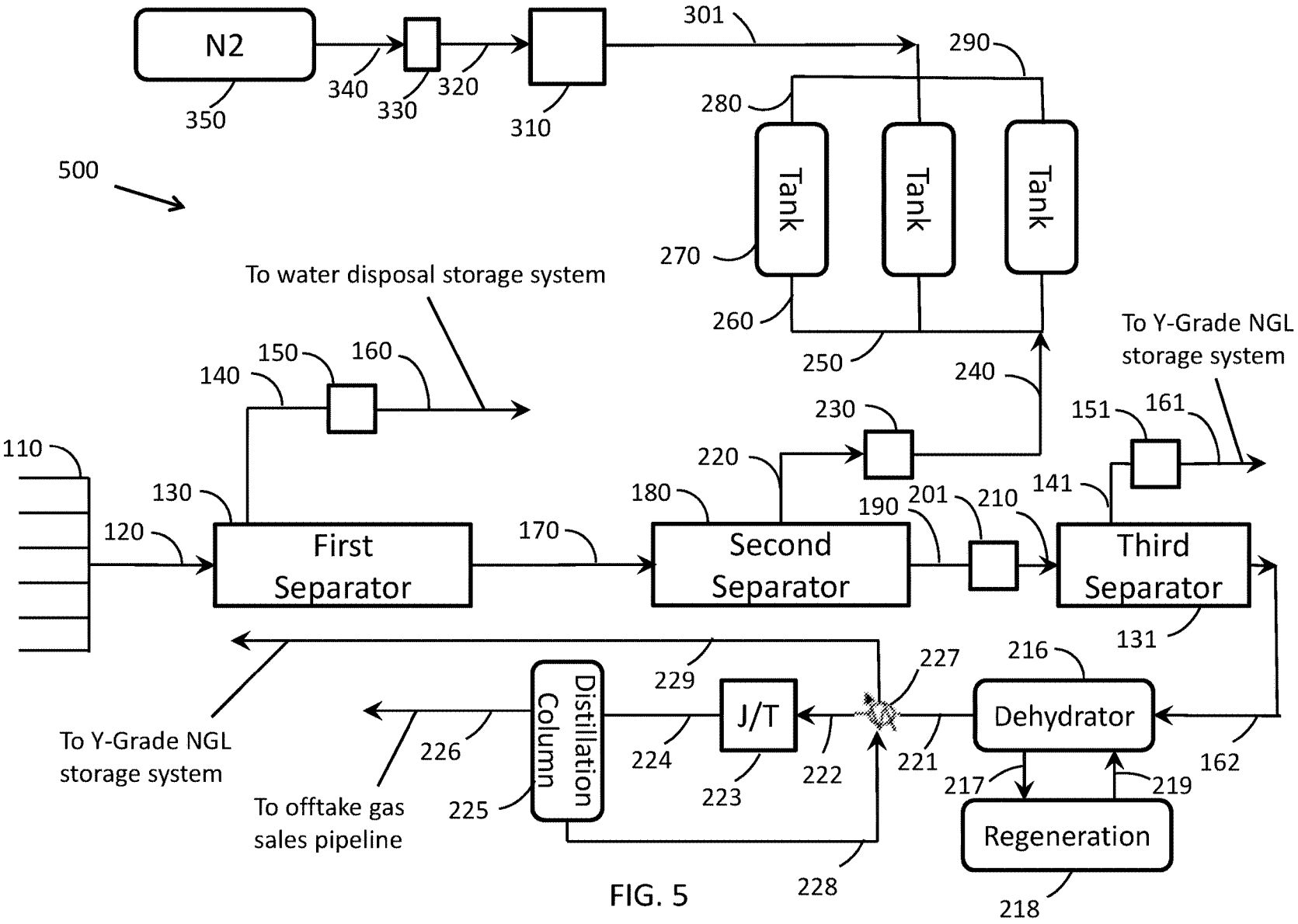
FIG. 5 shows a plan schematic of an in-line L-Grade recovery system according to one embodiment.

FIG. 5 shows a plan schematic of an L-Grade recovery system 500 that can be used to recover and create a unique composition of L-Grade and Y-Grade NGL. The recovery system 500 is similar to the recovery system 400 shown in FIG. 4. One difference of the recovery system 500 from the recovery system 400 is the addition of a glycol dehydration and regeneration system (comprising a glycol dehydrator 216 and a glycol regeneration unit 218), a heat exchanger 227, a Joule-Thomson valve 223, and a distillation column 225.

The gas stream discharged from the third in-line separator 131 flows into the glycol dehydrator 216 via line 162 and is contacted with a glycol to dehydrate the gas stream by absorbing and removing water vapor from the gas stream. The saturated glycol exits the glycol dehydrator 216 via line 217 and enters a glycol regeneration unit 218 to flash off the water vapor from the glycol, which is recycled back to the glycol dehydrator 216 via line 219 for reuse. The glycol used in the glycol dehydrator 216 and the glycol regeneration unit 218 may include any one or combination of ethylene, diethylene, triethylene, and tetraethylene.

The dehydrated gas stream exits the glycol dehydrator 216 via line 221 and enters the heat exchanger 227 where the gas stream is cooled by heat exchange with a Y-Grade NGL stream flowing into the heat exchanger 227 via line 228. The cooled, dehydrated gas stream exits the heat exchanger 227 via line 222 and flows through the Joule-Thomson valve 223 where the gas stream is super-cooled to a temperature between −20 degrees Fahrenheit and 0 degrees Fahrenheit. Since the gas stream is cooled in the heat exchanger 227 prior to entering the Joule-Thomson valve 223, less energy is required to super-cool the gas stream.

The super-cooled, dehydrated gas stream exits the Joule-Thomson valve 223 via line 224 and enters a high pressure distillation column 225 where additional Y-Grade NGL is separated out from the super-cooled, dehydrated gas stream. The high pressure distillation column 225 may have a pressure of about 5-10 bar. The Y-Grade NGL exits the high pressure column 225 via line 228 and flows through the heat exchanger 227 where the Y-Grade NGL is warmed by heat exchange with the dehydrated gas stream discharged from the glycol dehydrator 216 via line 221 as stated above. The Y-Grade NGL is then sent to a Y-Grade NGL storage system via line 229. The remaining gas stream exits the high pressure distillation column 225 and flows into an offtake gas sales pipeline via line 226.

Figure 6:
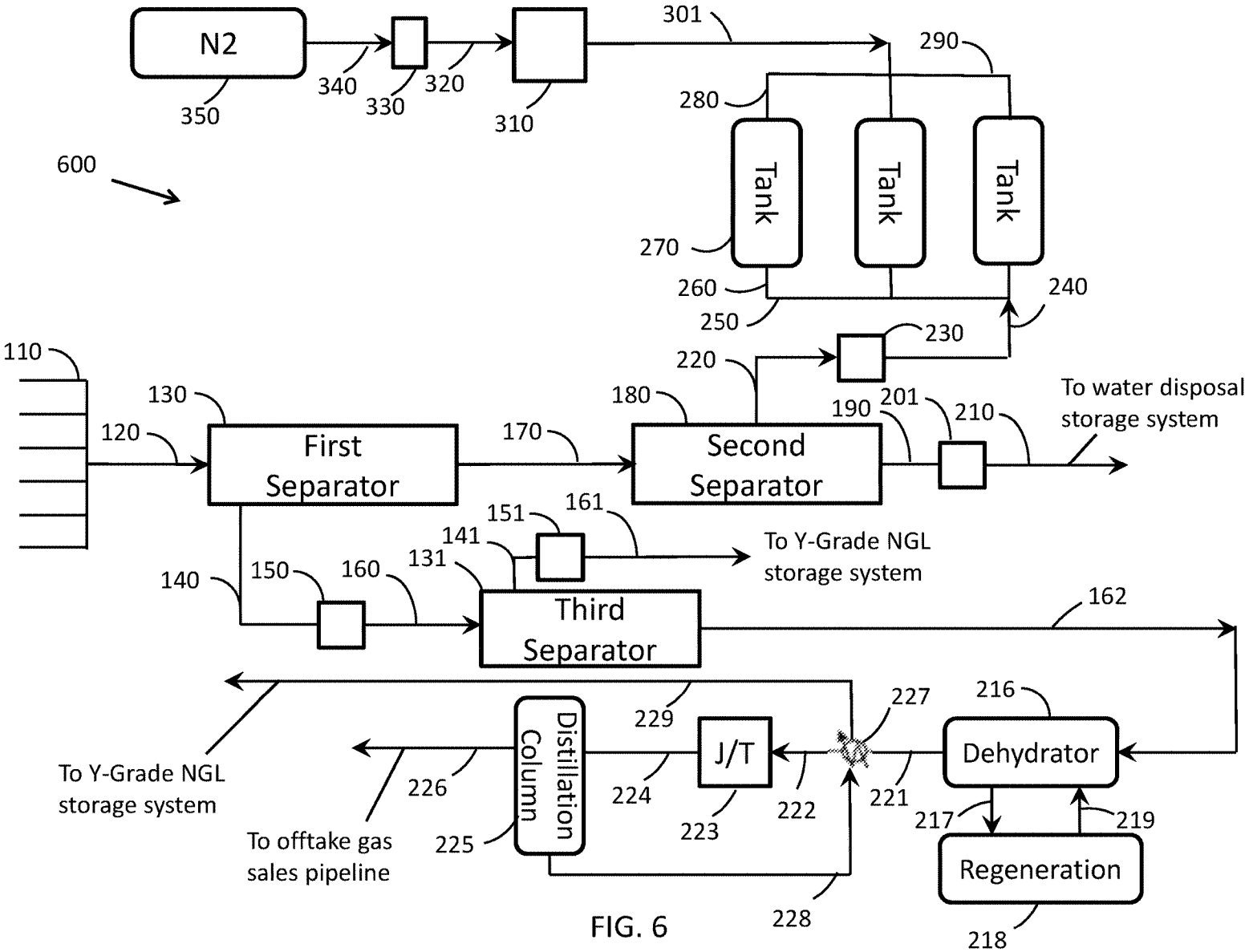
FIG. 6 shows a plan schematic of an in-line L-Grade recovery system according to one embodiment.

FIG. 6 shows a plan schematic of an L-Grade recovery system 600 that can be used to recover and create a unique composition of L-Grade and Y-Grade NGL. The recovery system 600 is similar to the recovery system 300 shown in FIG. 3. One difference of the recovery system 600 from the recovery system 300 is the addition of the glycol dehydration and regeneration system (comprising the glycol dehydrator 216 and the glycol regeneration unit 218), the heat exchanger 227, the Joule-Thomson valve 223, and the distillation column 225.

The gas stream discharged from the third in-line separator 131 flows into the glycol dehydrator 216 via line 162 and is contacted with a glycol to dehydrate the gas stream by absorbing and removing water vapor from the gas stream. The saturated glycol exits the glycol dehydrator 216 via line 217 and enters a glycol regeneration unit 218 to flash off the water vapor from the glycol, which is recycled back to the glycol dehydrator 216 via line 219 for reuse. The glycol used in the glycol dehydrator 216 and the glycol regeneration unit 218 may include any one or combination of ethylene, diethylene, triethylene, and tetraethylene.

The dehydrated gas stream exits the glycol dehydrator 216 via line 221 and enters the heat exchanger 227 where the gas stream is cooled by heat exchange with a Y-Grade NGL stream flowing into the heat exchanger 227 via line 228. The cooled, dehydrated gas stream exits the heat exchanger 227 via line 222 and flows through the Joule-Thomson valve 223 where the gas stream is super-cooled to a temperature between −20 degrees Fahrenheit and 0 degrees Fahrenheit. Since the gas stream is cooled in the heat exchanger 227 prior to entering the Joule-Thomson valve 223, less energy is required to super-cool the gas stream.

The super-cooled, dehydrated gas stream exits the Joule-Thomson valve 223 via line 224 and enters a high pressure distillation column 225 where additional Y-Grade NGL is separated out from the super-cooled, dehydrated gas stream. The high pressure distillation column 225 may have a pressure of about 5-10 bar. The Y-Grade NGL exits the high pressure column 225 via line 228 and flows through the heat exchanger 227 where the Y-Grade NGL is warmed by heat exchange with the dehydrated gas stream discharged from the glycol dehydrator 216 via line 221 as stated above. The Y-Grade NGL is then sent to a Y-Grade NGL storage system via line 229. The remaining gas stream exits the high pressure distillation column 225 and flows into an offtake gas sales pipeline via line 226.

While the foregoing is directed to certain embodiments, other and further embodiments may be devised without departing from the basic scope of this disclosure.

The invention claimed is:

1. A method of recovery from an L-Grade recovery system, comprising:

separating a natural gas stream into a hydrocarbon stream and water by a first in-line separator;

separating the hydrocarbon stream into L-Grade and a gas stream by a second in-line separator;

separating out Y-Grade NGL from the gas stream by a third in-line separator in communication with the second in-line separator;

dehydrating the gas stream by contacting the gas stream with glycol from a glycol dehydration and regeneration system in communication with the third in-line separator;

cooling the gas stream to a temperature between −20 degrees Fahrenheit and 0 degrees Fahrenheit by flowing the gas stream through a Joule-Thomson valve in communication with the glycol dehydration and regeneration system; and storing the L-Grade in a storage tank.

2. The method of claim 1, further comprising separating out additional Y-Grade NGL from the gas stream by flowing the gas stream through a distillation column in communication with the Joule-Thomson valve.

3. The method of claim 1, wherein the glycol used in the glycol dehydration and regeneration system includes one or a combination of ethylene, diethylene, triethylene, and tetraethylene.

4. The method of claim 1, further comprising supplying gaseous nitrogen to the storage tank with a nitrogen blanketing system.

5. The method of claim 1, further comprising sending the Y-Grade NGL from the third in-line separator to a Y-Grade NGL storage system.

6. The method of claim 1, wherein the L-Grade comprises natural gas liquids and condensate with an API gravity ranging between 50 degrees and 75 degrees.

7. The method of claim 1, wherein the glycol dehydration and regeneration system includes a dehydrator unit configured to remove water vapor from the gas stream by contacting the gas stream with glycol to absorb water vapor from the gas stream.

8. The method of claim 7, wherein saturated glycol exits the dehydrator unit and enters a regeneration unit of the glycol dehydration and regeneration system to flash off the water vapor from the glycol.

9. The method of claim 8, wherein the glycol from the regeneration unit is recycled back into the dehydrator unit for reuse.

10. The method of claim 1, wherein the L-Grade is an unfractionated hydrocarbon mixture comprising natural gas liquids, condensate, and at least one of water, carbon dioxide, nitrogen, and hydrogen sulfide.

11. The method of claim 10, wherein the natural gas liquids in the L-Grade mixture comprise ethane, propane, butane, isobutane, and pentane plus.

12. The method of claim 11, wherein the pentane plus comprises pentane, isopentane, and/or heavier weight hydrocarbons.

13. The method of claim 1, further comprising flowing the gas stream through a heat exchanger in communication with the glycol dehydration and regeneration system to cool the gas stream prior to cooling the gas stream by flowing through the Joule-Thomson valve.

14. The method of claim 13, further comprising separating out additional Y-Grade NGL from the gas stream with a distillation column after flowing the gas stream through the Joule-Thomson valve.

15. The method of claim 14, wherein the distillation column has a pressure of 5-10 bar.

16. The method of claim 14, wherein the remaining gas stream exits the distillation column and flows into an offtake gas sales pipeline.

17. The method of claim 14, further comprising flowing the additional Y-Grade NGL through the heat exchanger to cool the gas stream flowing through the heat exchanger.

18. The method of claim 17, further comprising sending the additional Y-Grade NGL to a Y-Grade NGL storage system.

19. The method of claim 1, wherein the Y-Grade NGL is an unfractionated hydrocarbon mixture comprising ethane, propane, butane, isobutane, and pentane plus.

20. The method of claim 19, wherein the ethane content of the Y-Grade NGL is within a range of 3-12 percent.

21. The method of claim 19, wherein the ethane content of the Y-Grade NGL is within a range of 38-60 percent.

22. The method of claim 19, wherein the pentane plus comprises pentane, isopentane, and/or heavier weight hydrocarbons.

23. The method of claim 19, wherein the propane content of the Y-Grade NGL is within a range of 15-45 percent.

24. The method of claim 19, wherein the butane content of the Y-Grade NGL is within a range of 5-10 percent.

25. The method of claim 19, wherein the isobutane content of the Y-Grade NGL is within a range of 5-40 percent.

26. The method of claim 19, wherein the pentane plus content of the Y-Grade NGL is within a range of 5-25 percent.

27. The method of claim 19, wherein the Y-Grade NGL has less than 1 percent methane.

* * * * *